US005607334A

United States Patent [19]

Garofalo

[11] Patent Number: 5,607,334

[45] Date of Patent: Mar. 4, 1997

[54] SWIM FIN EQUIPED WITH BUCKLE FOR THE FASTENING OF THE HEEL STRAP

[75] Inventor: Giovanni Garofalo, Rappallo, Italy

[73] Assignee: HTM Sport S.p.A., Italy

[21] Appl. No.: 584,394

[22] Filed: Jan. 11, 1996

[30] Foreign Application Priority Data

Jan. 11, 1995 [IT] Italy ..... GE95A0003

[51] Int. Cl.[6] ..... A63B 31/08

[52] U.S. Cl. ..... 441/64; D21/239

[58] Field of Search ..... 441/61–64; 280/11.3, 280/11.31, 611, 616, 617, 619, 621, 623, 626, 631, 634, 637; D21/239

[56] References Cited

U.S. PATENT DOCUMENTS 4,795,385 1/1989 Matsuoka ..... 441/64

FOREIGN PATENT DOCUMENTS 1223430 6/1960 France .
762166 11/1956 United Kingdom .

*Primary Examiner*—Jesus D. Sotelo
*Attorney, Agent, or Firm*—Larson and Taylor

[57] ABSTRACT

Swim fin equipped with buckle to secure the heel strap to the open foot pocket swim fin, such swim fin being provided sidewise of the foot pocket with a pin provided with a head enlarged with respect to its stem, and said buckle being provided with an opening, said pin and said opening being coupled for the connection of the buckle to the swim fin; said pin is provided with a radial tooth which cooperates with an abutment element protruding from the perimeter of the buckle opening, such tooth being positioned on the pin in such a manner as to prevent the downward rotation past a certain degree of the buckle with respect to the pin.

3 Claims, 2 Drawing Sheets

SWIM FIN EQUIPED WITH BUCKLE FOR THE FASTENING OF THE HEEL STRAP

BACKGROUND AND SUMMARY OF THE INVENTION

This invention relates to the swim fins, particularly the open foot pocket kind swim fins provided with heel strap secured at both sides of the pocket for the foot, and more particularly it relates to a buckle and pin system for the fastening of the strap to the swim fin itself.

Many combinations for swim fins of such kind are known in the art.

Apart from the kind of the buckle function itself, in the most part of the fins with open foot pocket of more recent kind, the connection between heel strap and swim fin is realized by a couple of pins protruding at both sides of the swim fin foot pocket, and normally made integral with it, and an opening formed on an element of the buckle. This connection is, for utilization convenience, pivoting around said pin, nevertheless such a characteristic may present also some disadvantages. For instance, the buckle, when the strap is not worn on the heel, may slip under the foot pocket, and may be accidentally crushed, with a consequent damage, which may consist into the deformation or the complete breaking of the buckle itself.

Scope of the present invention is a swim fin in which the connection between buckle and swim fin is free from the above mentioned drawbacks, even though it remains of practical and simple application.

Therefore, object of this invention is a swim fin provided with buckle to secure the heel strap to the open foot pocket swim fin, such a swim fin being provided with a pin provided with an enlarged mushroom-shape head at both sides of the foot pocket, and said buckle being provided with an opening, said pin and said opening being coupled for the connection of the buckle to the swim fin, characterized by the fact that said pin presents a radial tooth which cooperates with abutment elements protruding from the perimeter of the opening of the buckle, such a tooth being positioned on the pin in such a position that the rotation downwards would result hindered beyond a certain point of the buckle with respect to the pin.

Advantageously the abutment elements of the buckle are elastic, so to enable an easy engagement and disengagement of the buckle.

According to a further embodiment, said opening of the buckle has a not round perimeter, which allows to limit, in cooperation with said tooth of the pin, even the rotation of the buckle upwards with respect to the pin.

BRIEF DESCRIPTION OF THE DRAWINGS

Further advantages and characteristics will result evident from the following description of a preferred embodiment of the present invention, made by way of example not limitative, with reference to the accompanying drawings, in which.

DESCRIPTION OF ONE PREFERRED EMBODIMENT OF THE INVENTION

Figure 1:
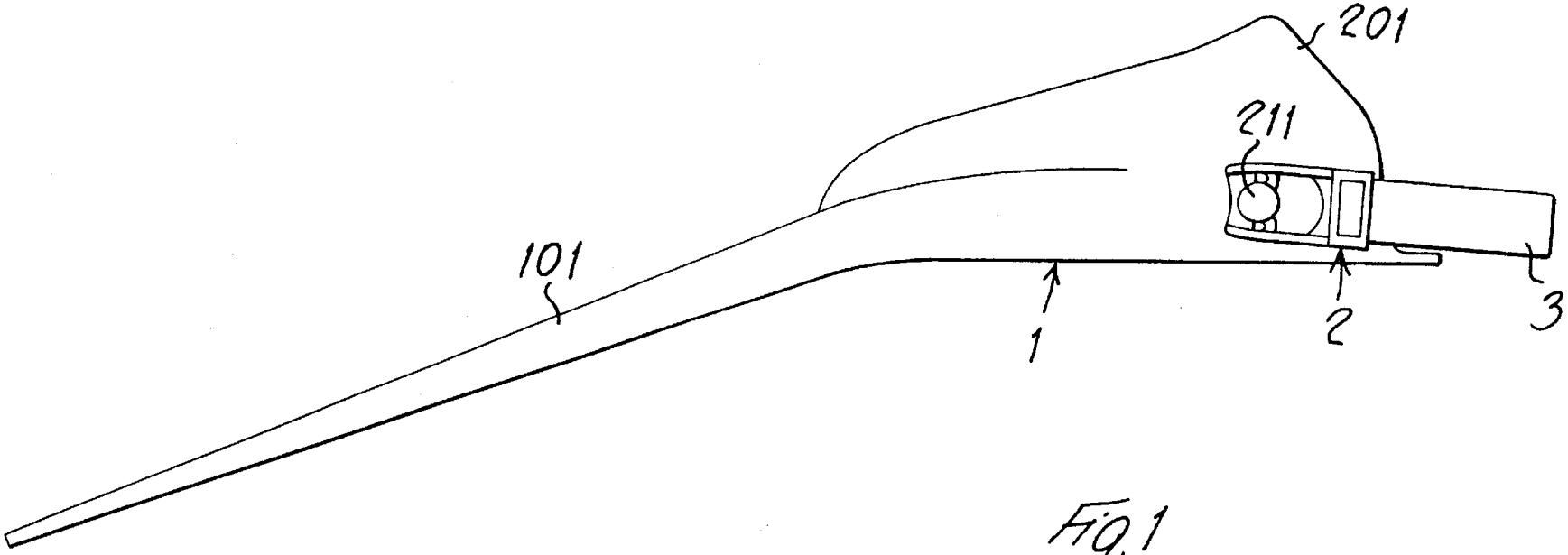
FIG. 1 is a side elevation view of a swim fin according to the invention.

In FIG. 1, with 1 the swim fin according to the present invention is shown. This swim fin 1, which is of the open foot pocket kind, comprises the blade portion 101, and the foot pocket 201. From each side of said pocket 201, a pin 211 provided with an enlarged head and formed integral with the pocket 201 protrudes, the buckle 2 of the heel strap 3 being secured to such pocket.

Figure 2:
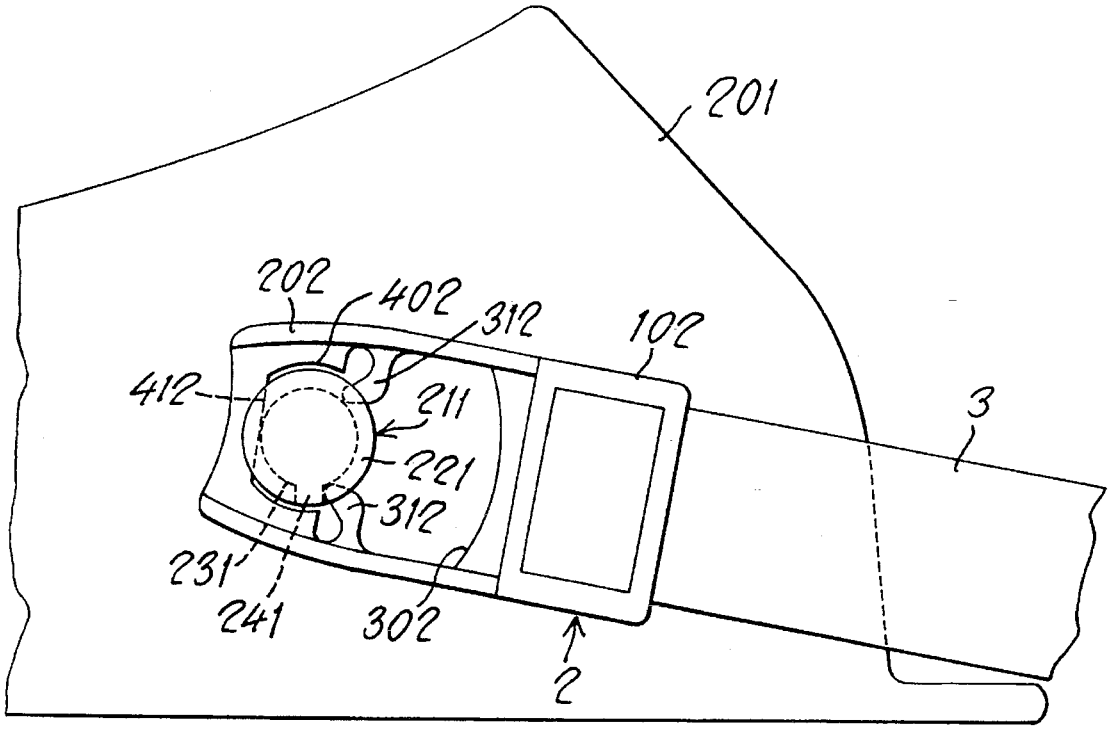
FIG. 2 is a side elevation view of an enlarged particular of FIG. 1.

In FIG. 2, the enlarged fin portion is shown at the point of attachment of the buckle 2 to the swim fin 1. The pin 211 results particularly formed by a rod 231 and a head 221 of greater diameter with respect to the rod; from said rod 231 a tooth 241 radially protrudes, whose purpose will be described later. The buckle 2 comprises a portion of adjustment means 102 to which the strap 3 is connected, the description of which lies outside the field of the present invention. Connected with such a portion 102, there is the connecting portion 202 of the buckle 2 with the swim fin. Said portion is provided with an ample opening 302 symmetrical with respect to the longitudinal axis of the buckle 2, which is apt to receive the head 221 of the pin 211. The opening 302 on the side opposite to the one turned towards the adjustment means 102 of the buckle narrows into a partially circular loop 402 with the exception of the rectilinear edge 412. Next to this loop 402 two relieves 312 on the opposite sides of the opening, made with substantially J shaped contour, whose free extremities are turned towards said loop 402, being the space comprised between the relieves 312 and the edge 412 suitable to contain the rod 231 of the pin 211, protrude from the perimeter of said opening.

Figure 3:
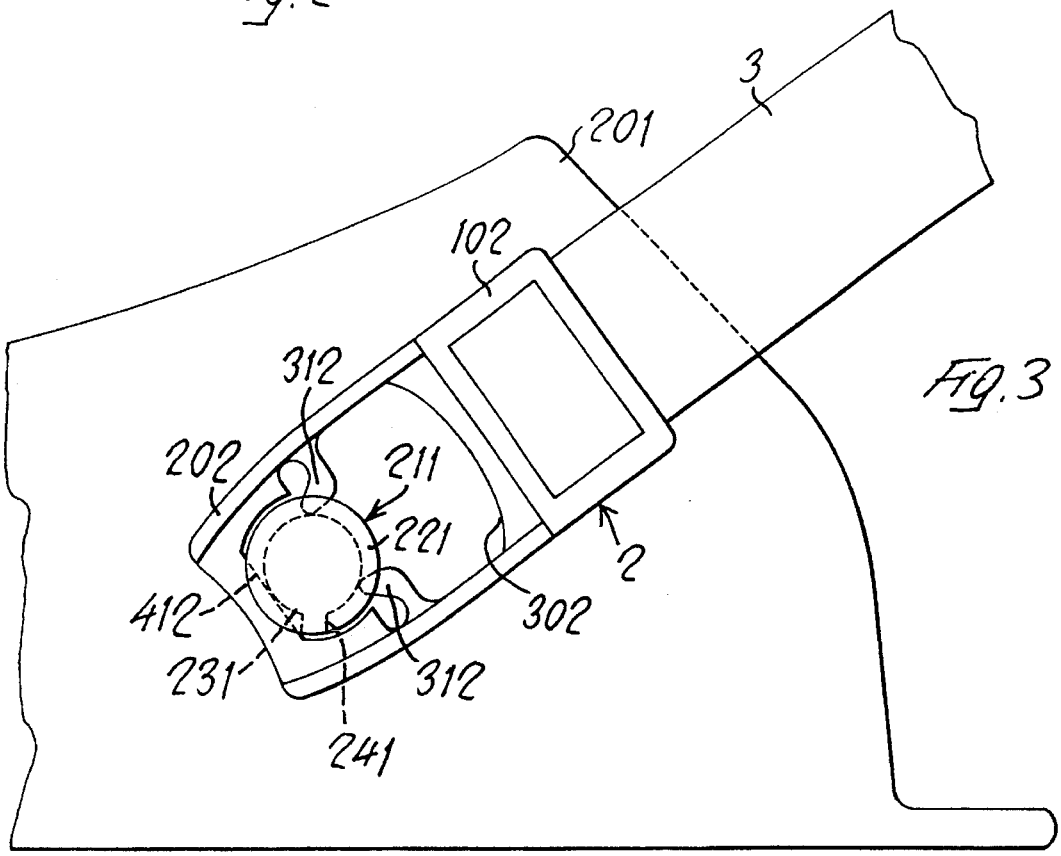
FIG. 3 is a view similar to the one of FIG. 2, with the strap and the buckle that have been rotated upwardly.

The illustrated parts in FIG. 3 are the same of the ones illustrated in FIG. 2 and therefore maintain the same numerals of reference.

The operation of the above mentioned device will result evident from what follows. On fitting up the buckle 2 on the swim fin 1, the pin 211 is inserted into the opening 302, into its largest part turned towards the adjustment means 102. Thereafter the buckle is pushed towards the open portion of the foot pocket 201, as much as the rod 231 of the pin 211 can fit into the loop 402, going over the relieves 312, whose free ends come in contact with the lateral surface of the rod 231 of the pin 211, sticking it de facto inside the said loop 402. At that point, by pushing the heel strap 3 downwards, also the buckle 2 is caused to rotate downwards until the free end of one of the relieves 312 comes to abut the radial tooth 241 protruding from the rod 231 of the pin 211. Thus the buckle results blocked and further rotation downwards is hindered by it.

Similarly, as illustrated in FIG. 3, when the heel strap is pushed upwards, the buckle rotates until the tooth 241 goes to abut the rectilinear edge 412 of the loop 402.

In this situation the rotation of the buckle 2 results equally hindered.

Advantageously the lengthened shank of the relieves 312 furnish them a certain elasticity which allows an easy engagement and disengagement of the buckle 2 on the pin 211 of the swim fin 1.

The swim fin so conceived shows an easy system of coupling the heel strap to the swim fin, which however keeps away from the risk of damages of the buckle of said strap caused from the rotation of the buckle itself on the connection pin.

I claim:

1. In a swim fin comprising: means defining a hollow foot receiving portion having a heel opening whereby a user may insert a foot into said hollow foot receiving portion, and an opposed toe portion; a blade extending forwardly of and integral with said toe portion; a flexible strap adapted to bear against the heel of a user when the user has his foot received into said hollow foot receiving portion; said strap being secured at its ends to a buckle provided with an opening; and said foot receiving portion being provided at its sides adjacent said heel opening with a pin projecting outwardly; said openings of said buckles being able to be coupled to said pins; the improvement according to which the said pins are provided with a stem having an enlarged head, and with a tooth radially projecting outwardly from said stem, and in which the the said opening of said buckles are provided with inwardly projecting abutment means cooperating with the said radial tooth so as to prevent the downward rotation past a certain degree of the said buckle with respect to said pin.

2. A swim fin according to the claim 1, in which said abutment means are elastic, so to allow an easy engagement and disengagement of the said buckle on the said stem of the said pin.

3. A swim fin according to the claim 1, in which said opening of the said buckle has a not round perimeter cooperating with said tooth of the said pin to limit the upwards rotation of said buckle with respect to the pin.

* * * * *